US008203289B2

(12) United States Patent
Ho et al.

(10) Patent No.: US 8,203,289 B2
(45) Date of Patent: Jun. 19, 2012

(54) INTERLEAVING MULTI-ENERGY X-RAY ENERGY OPERATION OF A STANDING WAVE LINEAR ACCELERATOR USING ELECTRONIC SWITCHES

(75) Inventors: Ching-Hung Ho, Antioch, CA (US); Stephen Wah-Kwan Cheung, Mountain View, CA (US); Roger Heering Miller, Mountain View, CA (US); Juwen Wang, Sunnyvale, CA (US)

(73) Assignee: Accuray, Inc., Sunnyvale, CA (US)

( * ) Notice: Subject to any disclaimer, the term of this patent is extended or adjusted under 35 U.S.C. 154(b) by 294 days.

(21) Appl. No.: 12/499,644

(22) Filed: Jul. 8, 2009

(65) Prior Publication Data

US 2011/0006708 A1 Jan. 13, 2011

(51) Int. Cl.
*H05H 9/04* (2006.01)
*H05H 7/12* (2006.01)

(52) U.S. Cl. ..... 315/505; 378/137

(58) Field of Classification Search ..... 315/505, 315/500, 501, 506, 507, 5.21, 5.41, 5.46, 315/3.5; 378/137
See application file for complete search history.

(56) References Cited

U.S. PATENT DOCUMENTS

| | | | | |
|---|---|---|---|---|
| 3,820,035 | A | 6/1974 | Meddaugh | |
| 4,286,192 | A | 8/1981 | Tanabe et al. | |
| 4,382,208 | A | 5/1983 | Meddaugh et al. | |
| 4,629,938 | A | 12/1986 | Whitham | |
| 4,713,581 | A | 12/1987 | Haimson | |
| 5,796,314 | A | 8/1998 | Tantawi et al. | |
| 5,801,598 | A | 9/1998 | Tantawi et al. | |
| 5,949,811 | A | 9/1999 | Baba et al. | |
| 6,459,761 | B1 | 10/2002 | Grodzins et al. | |
| 6,459,762 | B1 | 10/2002 | Wong et al. | |
| 7,005,809 | B2 * | 2/2006 | Whitham et al. | 315/500 |
| 7,112,924 | B2 * | 9/2006 | Hanna | 315/5.41 |
| 7,130,371 | B2 | 10/2006 | Elyan et al. | |
| 7,202,486 | B2 | 4/2007 | Gentry et al. | |
| 7,239,095 | B2 * | 7/2007 | Ho et al. | 315/505 |
| 7,580,505 | B2 | 8/2009 | Kang et al. | |
| 7,645,994 | B2 | 1/2010 | Tang et al. | |
| 7,646,851 | B2 | 1/2010 | Liu et al. | |
| 7,881,424 | B2 | 2/2011 | Zhang et al. | |

(Continued)

FOREIGN PATENT DOCUMENTS

JP 2008-198522 A 8/2008

(Continued)

OTHER PUBLICATIONS

International Search Report for PCT/US2010/021919, 3 pages, mailed Jun. 30, 2010.

(Continued)

*Primary Examiner* — Daniel D Chang
(74) *Attorney, Agent, or Firm* — Jones Day; Nicola A. Pisano; Jaime D. Choi

(57) ABSTRACT

The disclosure relates to systems and methods for fast-switching operating of a standing wave linear accelerator (LINAC) for use in generating x-rays of at least two different energy ranges with advantageously low heating of electronic switches. In certain embodiments, the heating of electronic switches during a fast-switching operation of the LINAC can be kept advantageously low through the controlled, timed activation of multiple electronic switches located in respective side cavities of the standing wave LINAC, or through the use of a modified a side cavity that includes an electronic switch.

30 Claims, 9 Drawing Sheets

U.S. PATENT DOCUMENTS

| | | | |
|---|---|---|---|
| 2005/0057198 | A1 | 3/2005 | Hanna |
| 2007/0035260 | A1 | 2/2007 | Ho et al. |
| 2007/0215813 | A1 | 9/2007 | Whittum et al. |
| 2007/0248214 | A1 | 10/2007 | Smith |
| 2008/0037843 | A1 | 2/2008 | Fu et al. |
| 2010/0034355 | A1 | 2/2010 | Langeveld et al. |
| 2010/0038563 | A1 | 2/2010 | Chen et al. |
| 2010/0111388 | A1 | 5/2010 | Seppi et al. |
| 2010/0188027 | A1 | 7/2010 | Treas et al. |
| 2010/0310045 | A1 | 12/2010 | Brown et al. |

FOREIGN PATENT DOCUMENTS

| | | | |
|---|---|---|---|
| JP | 2008-218053 | A | 9/2008 |
| WO | WO 2007/134514 | | 11/2007 |
| WO | WO 2009/080080 | A1 | 7/2009 |
| WO | WO 2010/019228 | A2 | 2/2010 |

OTHER PUBLICATIONS

Written Opinion of the International Searching Authority for PCT/US2010/021919, 8 pages, mailed Jun. 30, 2010.
Hanna, "Review of Energy Variation Approaches in Medical Accelerators," Proceedings of EPAC08 Genoa, Italy, pp. 1797-1799 (Jul. 2008).
International Search Report for PCT/US2010/040864, 4 pages, mailed Nov. 11, 2010.
Written Opinion of the International Searching Authority for PCT/US2010/040864, 9 pages, mailed Nov. 11, 2010.
U.S. Appl. No. 12/718,901, filed Mar. 5, 2010, Ho et al.
U.S. Appl. No. 12/697,031, filed Jan. 29, 2010, Treas et al.
U.S. Appl. No. 12/976,810, filed Dec. 22, 2010, Cheung et al.
U.S. Appl. No. 12/976,787, filed Dec. 22, 2010, Cheung et al.
Karzmark et al., "Medical Electron Accelerators," McGraw-Hill, Inc., 1993, pp. 82-87.
Maciszewski et al., "Application of Electronica 10-10' Electron Linac for Food Processing," 4$^{th}$ European Particle Accelerator Conference, Jun. 27-Jul. 1, 1994, London, England, pp. 2644-2646.
Pirozhenko, "Efficient Traveling-Wave Accelerating Structure for Linear Accelerators," Proceedings of EPAC08, Jun. 23-27, 2008, Genoa, Italy, pp. 2746-2748.
International Search Report for PCT/US2011/022834, mailed May 24, 2011, 4 pages.
Written Opinion of the International Searching Authority for PCT/US2011/022834, mailed May 24, 2011, 7 pages.
Aoi et al., "SU-FF-T-155: Development of an ultra-small C-band linear accelerator guide and automatic frequency controller," Med. Phys., vol. 34, issue 6, Jun. 2007, pp. 2436-2437.
Birdsey et al., "Pierce geometry electron guns as off-the-shelf nanosecond pulsed electron sources," Australian Institute of Physics 17th National Congress, Brisbane, Dec. 3-8, 2006, 4 pages.
Chetverikov et al., "The tuning method of the biperiodic accelerating structure of electron linear accelerator," Problems of Atomic Science and Technology (PAST), Ukraine, 2001, No. 3, pp. 99-100.
Dovbnya et al, "Two-frequency klystron amplifier," XVIII International Linac Conference, Geneva, Switzerland, Aug. 26-30, 2006, 3 pages.
Green, "Linear accelerators for radiation therapy, second edition" Taylor & Francis Group, New York, NY, pp. 27-47 (1997).
Guo et al., "Active RF pulse compression using an electrically controlled semiconductor switch," New Journal of Physics 8 (2006) 293, 17 pages.
Guo et al., "Active RF pulse compression using electrically controlled semiconductor switches," Contributed to 12th Advanced Accelerator Concepts Workshop (AAC 2006), Jul. 10, 2006 to Jul. 15, 2006, Lake Geneva, Wisconsin, 7 pages.
Guo et al., "Active RF pulse compression using electrically controlled semiconductor switches," Proceedings of EPAC 2006, Edinburgh, Scotland, pp. 3140-3142.
Huang et al, "Electron gun used in the accelerator for customs inspection systems," Proceedings of the Second Asian Particle Accelerator Conference, Beijing, China, 2001, 3 pages.
Iwashita, "Disk-and-washer LINAC structure with biperiodic T supports," IEEE Transactions on Nuclear Science, vol. NS-30, No. 4, Aug. 1983, pp. 3542-3544.
Jang et al., "Perveance monitor for measuring an 80-MW klystron characteristics," Proceedings of APAC 2004, Gyeongju, Korea, pp. 610-612.
Kamino et al., "Development of a new concept automatic frequency controller for an ultrasmall C-band linear accelerator guide," Med. Phys.. vol. 34, issue 8, Aug. 2007, pp. 3243-3248.
Khodak et al., "Electron gun for technological linear accelerator," Problems of Atomic Science and Technology (PAST), Ukraine, 2000, No. 2, pp. 86-88.
Miller et al., "Comparison of standing-wave and traveling-wave structures," Invited paper presented at the Stanford Linear Accelerator Conference, Stanford, California, Jun. 2-6, 1986, 6 pages.
Nantista et al., "Calculating RF profiles for beam loading compensation of arbitrary current profiles," Next Linear Collider (NLC) Note #25, Aug. 1997, 11 pages.
Ogorodnikov et al., "Processing of interlaced images in 4-10 MeV dual energy customs system for material recognition," Physical Review Special Topics—Accelerators and Beams, vol. 5, 104701 (2002), 11 pages.
Oki et al., "Low output-impedance RF system for beam loading compensation," Research Center for Nuclear Physics (RCNP) Annual Report 2001, Osaka University, Japan, 2 pages.
Tamura et al. "Development of high-power X-band semiconductor microwave switch for pulse compression systems of future linear colliders," Physical Review Special Topics—Accelerators and Beams, vol. 5, 062001 (2002), 16 pages.
D'Auria et al., "A New Electron Gun Modulator for the LINAC," Proceedings of LINAC96, Aug. 1996, pp. 854-856.
Hernandez et al., "A 7MeV S-Band 2998MHz Variable Pulse Length Linear Accelerator System," Proceedings of 2005 Particle Accelerometer Conference, Knoxville, Tennessee, pp. 1895-1897.
Pont et al. "Status of the 100 MeV Preinjector for the ALBA Synchrotron," Proceedings of EPAC08, Jul. 2008, Genoa, Italy, pp. 811-813.
Purdy et al., "Dual energy x-ray beam accelerators in radiation therapy: an overview," Nuclear Instruments and Methods in Physics Research B10/B11, 1985, pp. 1090-1095.
Toma et al. "Aspects of the Control System for the Electron Linear Accelerators Built in Romania," International Conference on Accelerator and Large Experimental Physics Control Systems, 1999, Trieste, Italy, pp. 654-656.
USPTO Non-Final Office Action for U.S. Appl. No. 12/581,086, mailed Nov. 8, 2011, 6 pages.
USPTO Non-Final Office Action for U.S. Appl. No. 12/697,031, mailed Dec. 22, 2011, 18 pages.

* cited by examiner

INTERLEAVING MULTI-ENERGY X-RAY ENERGY OPERATION OF A STANDING WAVE LINEAR ACCELERATOR USING ELECTRONIC SWITCHES

1. FIELD OF THE INVENTION

The invention relates to systems and methods for fast-switching operation of a standing wave linear accelerator for use in generating x-rays of at least two different energy ranges.

2. BACKGROUND OF THE INVENTION

Linear accelerators (LINACs) are useful tools for medical applications, such as radiation therapy and imaging, and industrial applications, such as radiography, cargo inspection and food sterilization. In some of these applications, beams of electrons accelerated by the LINAC are directed at the sample or object of interest for performing a procedure or for analysis. However, in many of these applications, it is preferable to use x-rays to perform the procedure or analysis. These x-rays are generated by directing the electron beams from the LINAC at a x-ray emitting target.

Due to space availability, most medical instruments use standing wave LINACs to accelerate the electrons since standing wave LINACs can be made smaller than traveling wave LINACs. In some medical applications, x-rays of more than one energy band may be desirable for analysis or to perform a procedure. Thus, a LINAC that can be operated to generate alternating outputs of electrons having different average energies is desirable. In theory, x-rays of different energy bands may be generated using electrons with different peak energies. However, the accelerating structure of a standing wave LINAC is generally configured to support only a limited number of allowed modes when the accelerator is operating efficiently, only one of which can accelerate a beam efficiently. It has been difficult to develop an instrument that can operate stably to output electrons at different energies at a sufficiently high dose rate of electrons for the desired applications.

An energy switch is commonly used in medical LINACs for a multi-x-ray energy operation. A mechanical type of energy switch, which comprises a metal plunger actuated by a linear motion actuator, is used in many medical therapy machines. In eight (8) hours of typical operation, if two energies are interleaved, it may be required to activate a switch on the order of 10 million times, which can limit the lifetime of a mechanical switch. An electronic switch can have faster a switching time and a longer expected lifetime than a mechanical switch. However, electronic switches can be prone to overheating during a fast-switching operation of the LINAC.

Systems and methods are disclosed herein for a multi-x-ray energy operation of a LINAC with advantageously low heating of electronic switches.

3. SUMMARY OF THE INVENTION

As disclosed herein, systems and methods are provided for use in a fast-switching operation of a standing wave linear accelerator such that heating in electronic switches located in side cavities of the accelerator is maintained advantageously low. The systems and methods comprise injecting a first set of electrons into a longitudinal passageway of the accelerator, where the accelerator comprises a plurality of main cavities and a plurality of side cavities, each the side cavity communicating with two neighboring main cavities of the plurality of main cavities, where the longitudinal passageway communicates with the plurality of main cavities, where at least two side cavities of the plurality of side cavities each comprises an electronic switch, thereby providing at least two detunable side cavities, where the first set of electrons is accelerated in the longitudinal passageway by an electromagnetic wave coupled into the accelerator, and where the first set of electrons are emitted from the accelerator at a first energy when the electronic switches of the detunable side cavities are activated to a first activation state; activating, substantially simultaneously, the electronic switches of at least two of the detunable side cavities to a second activation state; and injecting a second set of electrons into the longitudinal passageway, where the second set of electrons is emitted from the accelerator at a second energy which is different from the first energy. The systems and methods can further comprise, prior to injecting the first set of electrons into the longitudinal passageway, activating, substantially simultaneously, the electronic switches of the detunable side cavities to the first activation state. The electronic switches can be activated to the first activation state at a time interval of at least one switching time prior to the injecting the first set of electrons. The accelerator can comprise three or more detunable side cavities.

In the foregoing systems and methods, the detunable side cavities can be detuned, or tuned to the operating frequency, when the electronic switches are activated to the first activation state. The electronic switches can be activated to the second activation state at a time interval of at least one switching time prior to the injecting the second set of electrons. The at least two detunable side cavities can be detuned, or tuned to the operating frequency, when the electronic switches are activated to the second activation state. The detunable side cavities can be positioned adjacent to each other on a side of the accelerator. The detunable side cavities can be positioned diagonally across from each other on either side of the accelerator. In certain embodiments, the electronic switches can be activated to the first activation state by application of a first current to the electronic switches. In the foregoing embodiments, the step of activating the electronic switches to the second activation state can comprise applying a second current to the electronic switches, where the first current is different from the second current. In certain embodiments, the electronic switch can comprise a conductive member, where the conductive member is positioned inside the detunable side cavity. In the foregoing embodiments, an end of the electronic switch that extends to the exterior of the detunable side cavity can be capable of connecting to at least one coaxial transmission line. The electronic switches can be activated to a first activation state by connecting a first coaxial transmission line to each the electronic switches. The step of activating the electronic switches to a second activation state electronic switches comprises connecting a second coaxial transmission line to each the electronic switches, where the first coaxial transmission line is different from the second coaxial transmission line.

A standing wave linear accelerator is also disclosed, which comprises a plurality of main cavities and a plurality of side cavities, where each the side cavity couples to two neighboring main cavities of the plurality of main cavities, where at least one side cavity of the plurality of side cavities comprises an electronic switch, thereby providing at least one detunable side cavity, and where the at least one detunable side cavity is configured such that a reactance of the at least one detunable side cavity in the presence of an electromagnetic wave coupled into the accelerator, when the electronic switch is not activated, is substantially similar to a reactance of the side cavities that do not comprise an electronic switch. The at least one detunable side cavity further comprises one or more posts, and where the posts are configured such that the reactance of the at least one detunable side cavity in the presence of the electromagnetic wave coupled into the accelerator, when the electronic switch is not activated, is substantially similar to the reactance of side cavities that do not comprise an electronic switch. The at least one detunable side cavity further comprises one or more posts, where the detunable side cavity comprises copper, and where a material of the one or more posts is a copper alloy, brass, a ceramic, or combinations thereof.

As disclosed herein, systems and methods also are provided for operating a standing wave linear accelerator, comprising coupling an electromagnetic wave into the accelerator, where the accelerator comprises a plurality of main cavities and a plurality of side cavities, where each the side cavity couples to two neighboring main cavities of the plurality of main cavities, where at least one side cavity of the plurality of side cavities comprises an electronic switch, thereby providing at least one detunable side cavity, and where the at least one detunable side cavity is configured such that a reactance of the at least one detunable side cavity in the presence of an electromagnetic wave coupled into the accelerator, when the electronic switch is not activated, is substantially similar to a reactance of the side cavities that do not comprise an electronic switch; and injecting a set of electrons into the accelerator, where the set of electrons is emitted from the accelerator at an energy. The electronic switch can be activated prior to the coupling the electromagnetic wave into the accelerator. The electronic switch can be activated by applying a current to the electronic switch. In certain embodiments, the electronic switch can comprise a conductive member, and where the conductive member is positioned inside the detunable side cavity. In the foregoing embodiments, an end of the electronic switch can extend to the exterior of the detunable side cavity, where the end of the electronic switch is capable of connecting to at least one coaxial transmission line. The electronic switch is activated by connecting a coaxial transmission line to the end of the electronic switch.

As disclosed herein, systems and methods also are provided for use in a fast-switching operating of a standing wave linear accelerator such that heating in an electronic switch located in a side cavity of the accelerator is advantageously low. The method comprises injecting a first set of electrons into a longitudinal passageway of the accelerator, where the accelerator comprises a plurality of main cavities and a plurality of side cavities, each the side cavity communicating with two neighboring main cavities of the plurality of main cavities, where the longitudinal passageway communicates with the plurality of main cavities, where at least one side cavity of the plurality of side cavities each comprises an electronic switch, thereby providing at least one detunable side cavities, where the at least one detunable side cavity is configured such that a reactance of the at least one detunable side cavity in the presence of an electromagnetic wave coupled into the accelerator, when the electronic switch is not activated, is substantially similar to a reactance of the side cavities that do not comprise an electronic switch, where the first set of electrons is accelerated in the longitudinal passageway by an electromagnetic wave coupled into the accelerator, and where the first set of electrons are emitted from the accelerator at a first energy while the electronic switch is not activated; activating the electronic switch of the at least one detunable side cavity; and injecting a second set of electrons into the longitudinal passageway, where the second set of electrons is emitted from the accelerator at a second energy which is different from the first energy. The electronic switch can be activated prior to injecting the second set of electrons. The electronic switch can be activated by applying a current to the electronic switch. In certain embodiments, the electronic switch can comprises a conductive member, and where the conductive member is positioned inside the detunable side cavity. In the foregoing embodiments, an end of the electronic switch extends to the exterior of the detunable side cavity, where the end of the electronic switch is capable of connecting to at least one coaxial transmission line. The electronic switch can be activated by connecting a coaxial transmission line to the end of the electronic switch.

4. BRIEF DESCRIPTION OF THE DRAWINGS

5. DETAILED DESCRIPTION OF THE INVENTION

Systems and methods are provided for fast-switching operation of a standing wave LINAC such that heating of electronic switches located in side cavities of that accelerator is advantageously low.

Standing wave LINACs operate by generating electrons having particular average energies. In operation, electrons that are injected into a standing wave LINAC by an electron gun (described in Section 5.4.1), are accelerated along a longitudinal axis of an accelerating structure of the standing wave LINAC using the electric field of an electromagnetic wave that is fed into the accelerating structure (discussed in Section 5.1 below). The electromagnetic waves are coupled into the accelerating structure from an external source of microwaves, such as a klystron or a magnetron (discussed in Section 5.4.3). The accelerating structure is configured so that it supports a standing wave mode of the electromagnetic wave. As the electrons traverse the accelerating structure, they are focused and accelerated in a series of main cavities of the LINAC's accelerating structure by forces exerted on the electrons by the electric and magnetic field components of the electromagnetic wave to produce a high-energy electron beam. As discussed in Section 5.1.1, the energy of the electron beam output from the standing wave LINAC can be controlled using switches positioned in side cavities of the accelerating structure.

During an interleaving operation, which involves a fast-switching operation of the standing wave LINAC to generate electron beams at two or more different energies, electronic switches can overheat. An electronic switch can be heated to much higher than the optimal operating temperature of the electronic switch, or even greater, when the electronic switch is activated (discussed in Section 5.1.1). Systems and methods disclosed herein provide for reduced heating in multiple electronic switches during a fast-switching operation of the LINAC through controlled, timed activation of the electronic switches (discussed in greater detail in Section 5.2.1). As discussed in Section 5.2.1, the multiple electronic switches can share, substantially equally, the microwave power losses. Also disclosed herein are methods for reducing the heating of an electronic switch located in a side cavity during a fast-switching operation of the LINAC through modification of the side cavity (see Section 5.2.2).

5.1 Standing Wave Linear Accelerator

Figure 1:
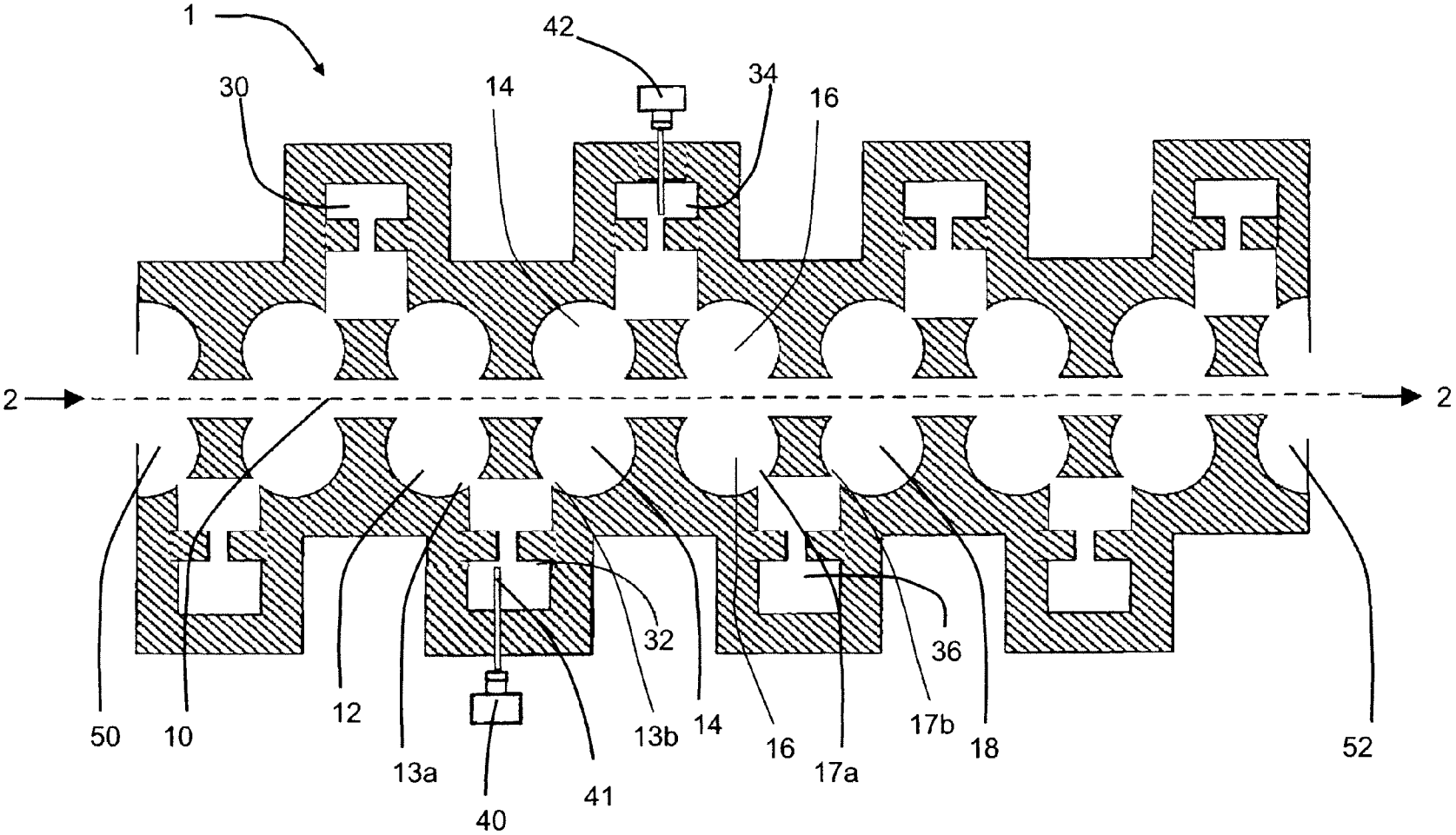
FIG. 1 shows a cross-section of the accelerating structure of a standing wave LINAC structure.

Provided herein are standing wave LINACs comprising electronic switches. A cross-section of an exemplary side-coupled standing wave LINAC structure is shown in FIG. 1. The side-coupled standing wave LINAC comprises an accelerating structure 1 that has a longitudinal passageway 10 and a plurality of electromagnetically coupled resonant main cavities 12, 14, 16, 18 positioned along the central bore of the accelerating structure. The longitudinal passageway 10 runs down the center of the accelerating structure. Those of skill in the art will recognize that the standing wave LINACs provided herein can have more or fewer main cavities than the illustration of FIG. 1. For example, a standing wave LINAC can have at least 10, at least 15, at least 20, at least 25, at least 30, at least 35, at least 40, or more main cavities. Main cavities 12, 14, 16, 18 are shaped like a toroid about the longitudinal passageway 10. A neighboring pair of main cavities is electromagnetically coupled by means of a side cavity through apertures. There are two types of side cavities. A first type of side cavity that comprises an electronic switch, such as side cavity 32 (shown in FIG. 1), couples adjacent main cavities 12 and 14 through apertures 13*a* and 13*b*. The second type of side cavity that does not comprise an electronic switch, such as side cavity 36 (see in FIG. 1), couples adjacent main cavities 16 and 18 through apertures 17*a* and 17*b*. Side cavities can be shaped, for example, approximately as a cube, approximately as a cylinder, approximately rectangular, or any other morphology deemed suitable by one of skill. As discussed in Section 5.1.1 below, side cavity 32 comprises an electronic switch that is used to tune the energy of the electrons that are emitted from the standing wave LINAC. The standing wave LINAC structure also can comprise an entrance cavity 50 and an exit cavity 52. The entrance cavity 50 and the exit cavity 52 can each be shaped essentially like one half of a main cavity. In certain embodiments, The entrance cavity 50 and the exit cavity 52 can be full cavities, each tuned to a different frequency. Entrance cavity 50 and exit cavity 52 each can have an end wall of finite thickness, with a beam hole similar in size to the longitudinal passageway.

In operation, an electromagnetic wave at around the $\pi/2$ mode resonant frequency of the accelerating structure 1 is coupled into the standing wave LINAC. Generally, the accelerating structure is resonant at microwave frequencies, typically between 0.3 GHz and 300 GHz. Typically, the microwave is coupled into one of the main cavities at a point along the longitudinal passageway through an iris or taper junction (not shown) leading from a microwave source. Sources of electromagnetic waves at microwave frequencies, such as a magnetron or a klystron, are discussed in Section 5.4.3. In certain embodiments, the electromagnetic wave can be coupled into one of the main cavities through an opening in the upper or lower portion of the accelerating structure, or into two main cavities through a taper or junction that replaces one of the side cavities. In the latter case, the adjacent main cavities are $\pi$ out of phase so the coupling to the adjacent main cavities can be done with two apertures on opposite sides of the broad wall of a rectangular waveguide where the magnetic field is in opposite directions.

The frequency of the microwave is such that a standing wave of the input electromagnetic wave is excited in the accelerating structure 1 at an allowed mode of the accelerating structure. The accelerating structure can be configured such that an allowed mode of the accelerating structure is a standing-wave resonance with $\pi/2$ radians phase shift between each side cavity and the adjacent downstream main cavity, or between a main cavity and a downstream side cavity. Thus, in certain embodiments, there is a shift of it radians between adjacent main cavities 12, 14, 16, 18. This standing wave mode can provide the greatest separation of resonant frequency from adjacent modes that might be accidentally excited. That is, the $\pi/2$ mode can provide desirable shunt impedance, wide mode separation, and loose tolerances for phase velocities between about half the velocity of light and the velocity of light, that can be useful for small LINAC. However, the skilled artisan can appreciate that other phase shifts can be used in accordance with the systems and methods disclosed herein. For example, the systems and methods disclosed herein are also applicable to triperiodic LINAC structures, which comprise three cavities per period, a $2\pi/3$ phase advance per cavity, and a node in every third cavity which are positioned off-axis or are greatly shrunken in length if positioned on-axis. In this example, the third cavities having a node can be tuned to decouple the downstream portions of accelerator structure as discussed in Sections 5.1 and 5.2. In another example, the systems and methods disclosed herein are also applicable to biperiodic standing wave structures in the $\pi/2$ mode that comprise on-axis coupling cavities that perform a function similar to the detunable side cavities discussed herein. In this example, the on-axis coupling cavities can be tuned, for example by changing their size, to decouple the downstream portions of accelerator structure as discussed in Sections 5.1 and 5.2.

A beam of electrons 2 is injected by an electron gun source (not shown) into the longitudinal passageway 10 near entrance cavity 50. Electron guns are discussed in Section 5.4.1 below. The electron beam 2 may be either continuous or pulsed. In a specific embodiment, the electron beam is pulsed. Accelerating structure 1 may also comprise bunching cavities located between entrance cavity 50 and main cavities 12, 14, 16, 18. The bunching cavities can be configured such that the electric field of the electromagnetic wave in the bunching cavities causes the electron beam to come together to form bunches and to focus and accelerate the electrons. The formation of electron bunches from an initial continuous beam takes place as the electrons traverse the bunching cavities, and the system can be configured so that the bunching is not significantly degraded by the accelerating electric field in the accelerating main cavities. The accelerating structure 1 is configured, and the frequency of the microwave is selected, such that the spacing between main cavities 12, 14, 16, 18 is about one-half of a free-space wavelength of the microwave. The injected electron beam 2 (comprising electron bunches) is accelerated in each of the main cavities towards the exit cavity 52, so that electrons accelerated in one main cavity 12 arrive at the next main cavity 14 at the point in time when the electric field of the microwave in cavity is in a phase that exerts additional forward acceleration on the electron beam 2. The electron beam 2 (comprising electron bunches) is accelerated to nearly the speed of light usually in the first few main cavities. The acceleration exerted by the electric field components of the standing waves in the remaining main cavities further increases the energy of the electrons (i.e., increases their relativistic mass).

After being accelerated, electron beam 2 is emitted from the standing wave LINAC structure from exit cavity 52. In applications that use x-ray radiation, the emitted electron beam 2 can be directed at an x-ray target (not shown). The generation of x-rays and examples of targets are discussed in Section 5.3 below. Alternatively, a vacuum window comprising a thin metal film may be placed at exit cavity 52 to transmit the electron beam 2 for particle irradiation of a subject.

5.1.1 Electron Output Energy Control Using A Switch in a Side Cavity

Figure 2A:
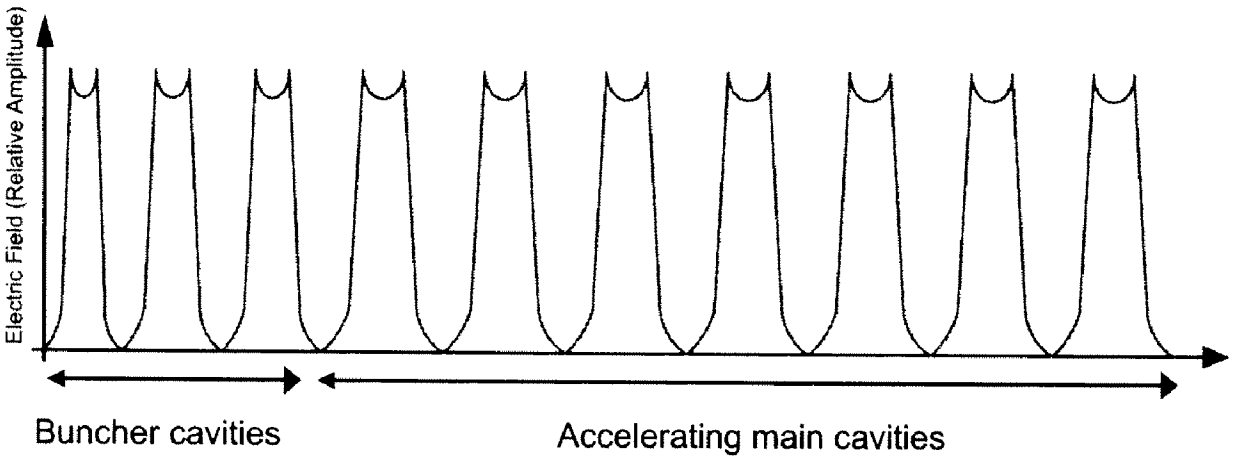
FIG. 2A shows a plot of the variation of the electric field amplitude in the accelerating main cavities of a standing wave LINAC.

If all of the main cavities 12, 14, 16, 18 are similar and approximately axially symmetrical about the longitudinal passageway 10, and all of the side cavities are similar to side cavity 30 or side cavity 36, the electric field in each main cavity will be substantially the same as the field in the other main cavities. As a result, the electron beam 2 will experience a maximum of the electric field amplitude (and thus a maximum forward acceleration) in all of the main cavities. FIG. 2A shows the variation of the amplitude of the electric field that acts on an electron beam in each of the main cavities as a function of an axial position along the longitudinal passageway of the standing wave LINAC's accelerating structure during an operation where the electrons are accelerated in every main cavity. The electron beam that is emitted from an exit cavity of the LINAC is accelerated to an energy that is near the maximum attainable final output energy of the standing wave LINAC system.

If an output electron beam at a different energy is desired, the standing wave at a downstream portion of the standing wave LINAC can be disrupted so that less acceleration acts on the electron beam. To accomplish this, one of the side cavities can be made asymmetrical with respect to its two neighboring main cavities to disrupt, to a controllable degree, the resonant coupling between its two neighboring main cavities. A switch positioned in the side cavity can be used to disrupt the resonant coupling. For example, a mechanical switch can be used disrupt the resonant coupling between the neighboring main cavities, where a mechanical adjustment of a plunger of the mechanical switch is inserted into the side cavity (see, e.g., U.S. Pat. No. 4,629,938). The geometrical asymmetry produces an asymmetry of the electromagnetic field distribution in the side cavity containing the mechanical switch so that the magnetic field component is greater at the aperture leading to the upstream main cavity than at the aperture leading to the downstream main cavity. The ratio of accelerating electric field components in the two main cavities neighboring the side cavity containing the mechanical switch is related to the ratio of magnetic fields on each of the apertures between the main cavities and the side cavity. By varying the degree of disruption of the magnetic field symmetry, such as by varying the degree of insertion of the mechanical plunger into the side cavity, the magnitude of the accelerating electric field in the main cavity downstream of the side cavity can be varied while leaving the accelerating electric field in the upstream main cavity essentially unchanged. In certain embodiments, the power of the electromagnetic wave fed into the LINAC also can be reduced to a level appropriate for the number of accelerating cavities that still support the standing wave after activation of the switch, and to maintain the electromagnetic fields in the buncher cavities at a favorable level. The buncher cavities work favorably over a fairly limited range of electromagnetic fields, and the bunching cavities may not function to accelerate the bunch of electrons appropriately so that the electron bunch (set of electrons) rides at or near the crest of the electromagnetic wave in the accelerating main cavities of the LINAC if the power of the electromagnetic field is not modified. If the bunch does not ride at or near the crest of the electromagnetic wave, the energy spectrum of the output electrons can become wide and the energy stability can deteriorate.

Figure 2B:
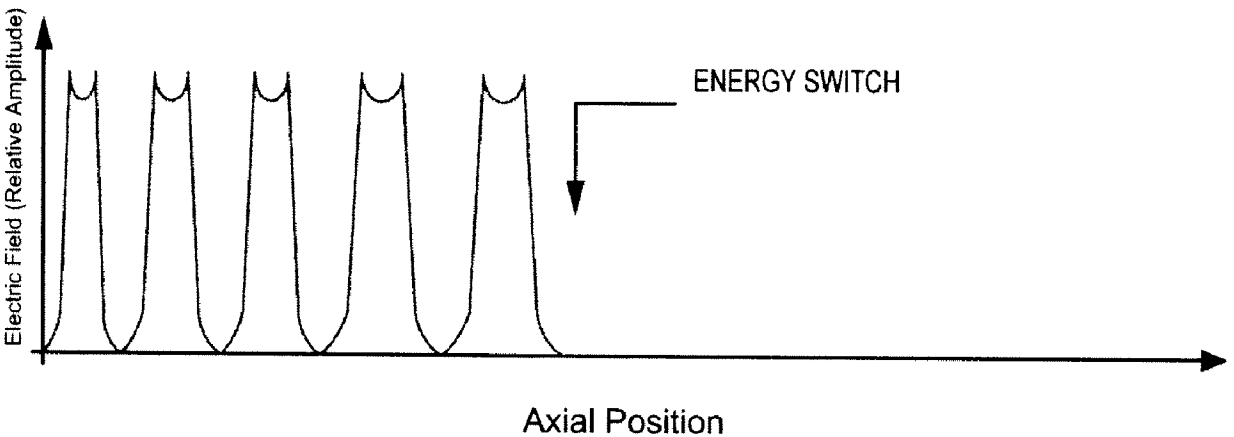
FIG. 2B shows a plot of the variation of the electric field amplitude in the accelerating main cavities of a standing wave LINAC in which an electronic switch has been activated.

FIG. 2B shows the variation of the amplitude of the electric field that acts on the electron beam 2 in each of the main cavities as a function of an axial position along the longitudinal passageway of the standing wave LINAC's accelerating structure during an operation where a switch in a side cavity is activated. The magnitude of the electric field component of the electromagnetic wave in main cavities located downstream of the activated switch is significantly reduced. The result is that the electron beam will experience considerably less acceleration in these downstream main cavities and attain a lower final energy. The energy of the output electron beam that is emitted from an exit cavity of the LINAC is lower than the maximum attainable energy of the standing wave LINAC system. A drawback of using mechanical switches is that the switching time of a mechanical switch can be slow. In an interleaving operation of a standing wave LINAC, it is desired to switch the LINAC quickly, and repeatedly, so that electron beams of at least two different, preferably stable, energies are emitted sequentially from the LINAC. In some applications, the switching time may be on the order of milliseconds. Although an actuator can be used to operate the plunger of a mechanical switch, the relatively slow switching time of a mechanical switch becomes a limiting factor on the switching speed of the LINAC. Furthermore, a mechanical switch has a limited lifetime. If it is assumed that a mechanical switch has a lifetime of one million cycles, it would wear out in about one hour of operation if an attempt is made to use it for an interleaving operation.

Electronic switches, which use electronic controls, can be switched on the order of milliseconds, much faster than mechanical switches. However, disadvantageous heating can occur in the side cavity due to flow of microwave power that is disrupted by the electronic switch. Specifically, the microwave power dissipated in the variable reactance of an electronic switch can cause it to over-heat, which can destroy the device. The reactance can result from an opposition to the electromagnetic wave of a capacitive element (capacitive reactance) and/or an inductive element (inductive reactance) of the electronic switch. Reactance can vary with the frequency of the electromagnetic wave. The power losses can cause the temperature of the electronic switch to rise much higher than its optimal operating temperature when the switch is activated, which can cause severe heating.

5.2 Systems and Methods for Reduced Heating During Fast-Switching Operation

In certain embodiments, provided herein are methods and systems that can be used to maintain advantageously low the amount of heating of multiple electronic switches during a fast-switching operation of the LINAC through (i) the controlled, timed activation of multiple electronic switches, each located in respective side cavities of the standing wave LINAC (discussed in Section 5.2.1), or (ii) the modification of a side cavity such that includes an electronic switch (discussed in Section 5.2.2). A system operated using either method (i) or method (ii), or using some combination of both method (i) and method (ii), also is within the scope of this disclosure.

5.2.1 Multiple Detunable Side Cavities

In one aspect, provided herein is a method for fast-switching, interleaving operation of a standing wave LINAC with advantageously low heating of the electronic switches of side cavities, where the LINAC is operated to emit electron beams that alternate between a first output energy and a second output energy. The method can comprise injecting a first set of electrons into the longitudinal passageway of the LINAC and accelerating the first set of electrons to a first output energy using an electromagnetic standing wave, activating, substantially simultaneously, the electronic switches of two or more detunable side cavities, injecting a second set of electrons into the longitudinal passageway and accelerating the second set of electrons to a second output energy. The first set of electrons are emitted from the LINAC at a first energy when the electronic switches of the detuning side cavities are activated to a first activation state. In the first activation state, the electronic switches may be inactive, or may be activated to a state in which they operate relative to the LINAC essentially as a side cavity that does not include an electronic switch. The second activation state of the electronic switches is different from the first activation state, such that the second energy is different from the first energy.

FIG. 1 shows a standing wave LINAC accelerating structure comprising detunable side cavities which can be operated according to this aspect. The LINAC comprises a plurality of main cavities and a plurality of side cavities. Two of the side cavities, side cavities 32 and 34, referred to herein as detunable side cavities, each comprises an electronic switch 40, 42. The electronic switches 40, 42 can be activated, substantially simultaneously, to detune the respective detunable side cavities 32, 34, which disrupts the standing wave propagation of the electromagnetic wave downstream of the respective detunable side cavities 32, 34. As a result, an electric field having a distribution along the longitudinal axis of the accelerating structure similar to the plot shown in FIG. 2B acts on the electrons, resulting in the output from the standing wave LINAC of electrons at a lower energy.

The electronic switches 40, 42 illustrated in FIG. 1 are each connected to a conductive member, such as conductive member 41, that extends into the respective detunable side cavity 32, 34. The conductive member may be a conductive prong or a conductive loop. The conductive member may comprise any electrical conductor. An end of the conductive member can extend to the exterior of the detunable side cavity, and may be connected by means of a switch to any type of element that can modify an electrical property of the conductive member. For example, the conductive member may be connected to one or more coaxial transmission cables or some other conductor by the electronic switch. When the electronic switch is activated, the attached element (i.e., the coaxial transmission cable or other conductor) changes the reactance of the detunable side cavity. The changed reactance changes the impedance of the detunable side cavity, and hence its resonant frequency. Alternatively, the electronic switch can be activated by application of a current or a voltage to the conductive member, which also may change the reactance of the detunable side cavity. Examples of electronic switches include, but not limited to, a microwave switch and a PIN diode switch.

In the absence of an electronic switch, a side cavity has approximately zero electric field, because the two neighboring main cavities have fields that are approximately equal and $\pi$ radians out of phase with each other. Since the electric fields on each side of a side cavity have opposite signs, the fields in a side cavity can balance the neighboring main cavities. That is, the field in a side cavity is proportional to the algebraic sum of the fields in the two neighboring main cavities. However, an interaction that couples the two apertures of a detuned side cavity, such as apertures 13*a* and 13*b* of detunable side cavity 32 of FIG. 1, can cause microwave power leak through the detuned side cavity. This leaked microwave power creates weak fields in the entire portion of the LINAC down stream of the detuned side cavity. By detuning a nearby, downstream second side cavity, the power that leaks through the first detuned side cavity is concentrated in the main cavity between these two side cavities, raising the field in the main cavity just downstream of the first detuned cavity in the correct phase to reduce the fields in the first detuned cavity. For example, with reference to FIG. 1, when the first detunable side cavity 32 is detuned (by activating electronic switch 40), the interaction of apertures 13*a* and 13*b* causes a power leak through detunable side cavity 32. By detuning downstream detunable side cavity 34 (by activating electronic switch 42), the power that leaks through detunable side cavity 32 is concentrated in main cavity 14, raising the field in main cavity 14 in the correct phase to reduce the fields in the detunable side cavity 32. This reduced field in detunable side cavity 32 results in advantageously low heating of the electronic switch of detunable side cavity 32. With appropriate detuning of the two detuned side cavities, it can be possible to equalize the microwave power dissipation in the two detuned side cavities. That is, through appropriate detuning of the two detuned side cavities, the multiple electronic switches can share, substantially equally, the microwave power losses. The second detuned side cavity can reduce the microwave power losses in the electronic switch of the first detuned side cavity.

By activating, substantially simultaneously, electronic switches 40 and 42 of the two detunable side cavities 32, 34, the heating in these two cavities can be kept advantageously low. Use of the two detuned side cavities can improve the decoupling of the portions of the LINAC downstream of the detuned side cavities, thereby substantially reducing the amplitude of the accelerating electric field in the decoupled regions, and providing control of the output energy of the electrons. Using two detunable side cavities helps reduce heating in the upstream detunable side cavity. The switching time of electronic switches can be on the order of microseconds.

Two or more electronic switches can be activated substantially simultaneously if they are all activated within a time interval on the order of microseconds of each other, such as a few microseconds, or tens or hundreds of microseconds. For example, the two or more electronic switches can be activated within about 10 microseconds of each other or less. In certain embodiments, the two or more electronic switches can all be activated within a time interval of about 1 microsecond of each other or less. Due to the essentially instantaneous power leak through the electronic switch once the first detunable side cavity is detuned, a longer delay between the activation of the first and second electronic switches can reduce the effectiveness of any benefit from detuning the two side cavities. That is, during a longer delay, the power leak through the first detuned side cavity can be sufficiently severe to damage the electronic switch of that side cavity. Activation of the two electronic switches substantially simultaneously reduces the possibility of overheating in the electronic switch of the detunable side cavity that is first detuned. As a result, the substantially simultaneous activation of the electronic switches can produce advantageously low heating of the electronic switches.

Another possible advantage of the substantially simultaneous activation of the two detunable side cavities is the response of an automatic frequency controller (AFC). An AFC can automatically maintain a tuning of the electromagnetic wave to a desired frequency. With heavy detuning of a side cavity, the separation between modes can be lost, and an AFC can lock to an incorrect mode (such as a mode of the detuned side cavity). Simultaneous activation of the two side cavities reduces the risk of the AFC locking on to an incorrect mode.

The activation of the electronic switches may be controlled by one or more control units. The control unit for the electronic switches may receive their commands from a computer system (such as commands stored in computer memory), from a computer readable medium, or from a user through a user input device. The control unit can be coupled to the electronic switches 40, 42, and is operable to control the resonant frequency of detunable side cavities 32, 34. The control unit for the electronic switches can be connected to an element that includes electrical circuitry for changing a current or a voltage to the electronic switches in order to activate the switches to the desired activation states. In order to cause the substantially simultaneous activation of electronic switches 40, 42, the control unit can issue a command so that each of the electronic switches is activated to the respective activation state that decouples the portions of the LINAC downstream of the detuned side cavities, thereby substantially reducing the accelerating electric field in the decoupled regions, and providing control of the output energy of the electrons. The same control unit that issues commands for controlling the electronic switches also may issue command for operating the other elements of the standing wave LINAC including, but not limited to, the timing and pulse length of injection of the electrons from the electron gun, the amplitude of the gun current, the timing, pulse length and amplitude of the electromagnetic wave coupled into the LINAC, and the instructions to the AFC. In another example, the control unit that issues commands for controlling the electronic switches may be separate from the control unit that issues commands for operation of the LINAC. The two or more control units advantageously would be in communication and synchronized in order to execute the steps of the method.

Figure 3:
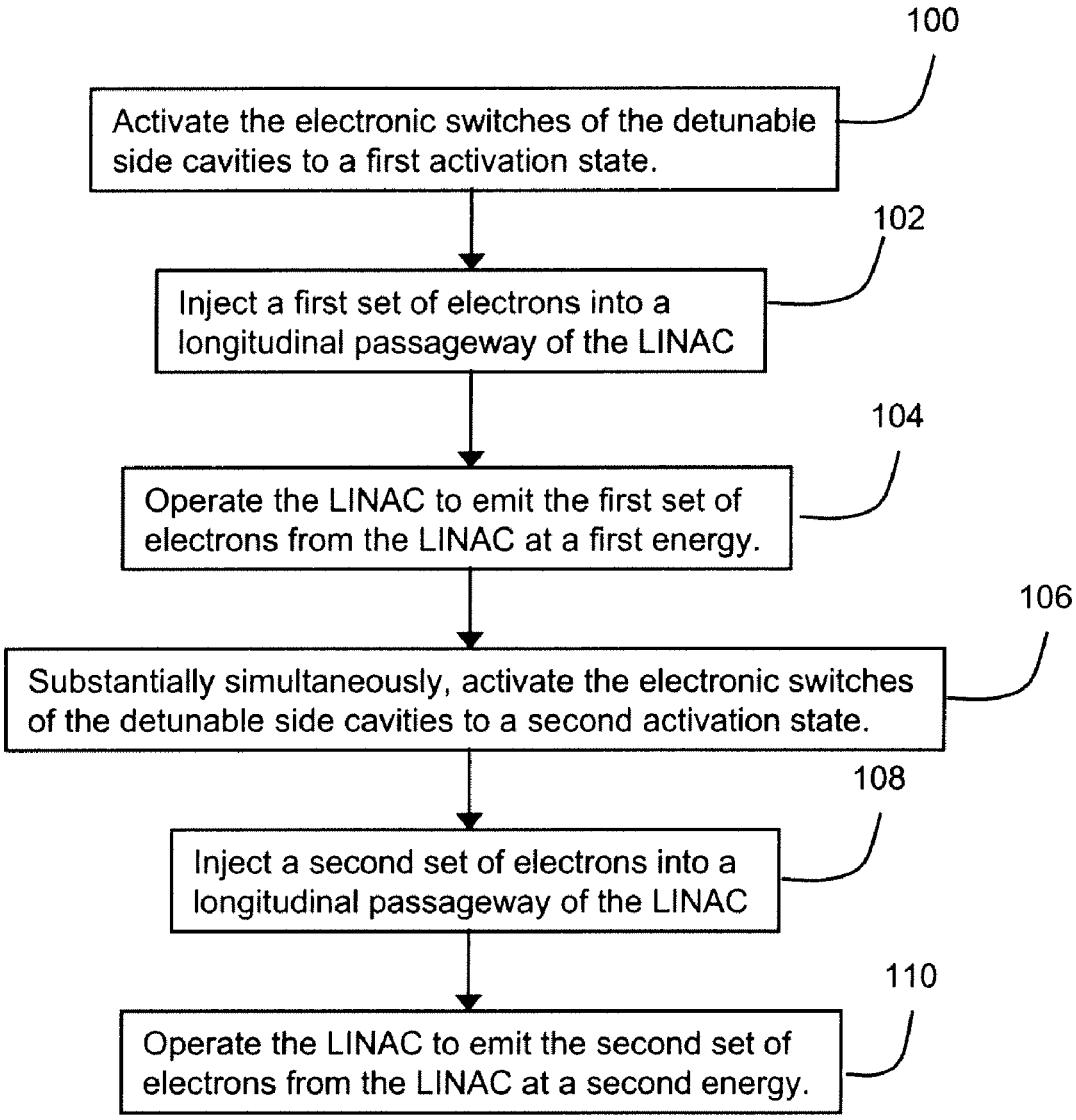
FIG. 3 shows a flow chart of the operation of a LINAC according to a first aspect.

The one or more control units may be programmed to issue commands to the standing wave LINAC and the electronic switches, where the execution of the steps of the commands results in a fast-switching operation of the LINAC such that heating in electronic switches located in side cavities of said accelerator is advantageously low. FIG. 3 shows a flow chart of commands that may be issued by the one or more control units for the electronic switches and the LINAC. In step 100 of FIG. 3, a command is issued to the electronic switches 40,42 to activate, substantially simultaneously, electronic switches 40, 42 to a first activation state. In step 102, a command is issued to the electron gun to inject a first set of electrons into longitudinal passageway 10 of the LINAC. In step 104, a command is issued to operate the LINAC so that the first set of electrons would be emitted from the LINAC at a first energy. Step 104 can include a command for coupling the electromagnetic wave into the LINAC and/or a command for initiating the AFC. The time interval between steps 100, 102 and 104, and the order of the steps, can be selected to result in the first set of electrons being emitted at the desired dose rate and first energy. For a LINAC that is less than a meter long, it can take several nanoseconds (e.g., about 3 ns) for the first set of electrons to travel the length of the LINAC, the filling time of the electromagnetic wave in the LINAC can be on the order of hundreds of nanoseconds or microseconds (e.g., about 200 ns for x-band, and about 1 μs for s-band), and the switching time for an electronic switch can be on the order of a few microseconds to tens of microseconds. Therefore, in certain embodiments, step 104 (e.g., coupling the electromagnetic wave into the LINAC) can be performed prior to steps 100 and 102. In step 106, a command is issued to activate, substantially simultaneously, electronic switches 40, 42 to a second activation state. In step 108, a command is issued to the electron gun to inject a second set of electrons into longitudinal passageway 10. In step 110, a command is issued to operate the LINAC so that the second set of electrons would be emitted from the LINAC at a second energy which is different from the first energy.

In an embodiment, the electronic switches 40, 42 can be activated to a first activation state that decouples the portions of the LINAC downstream of the detuned side cavities, substantially reducing the accelerating electric field in the decoupled regions. The first set of electrons would be accelerated by substantially the maximum attainable amplitude of the electric field of the electromagnetic wave in the main cavities upstream of the detuned side cavities, and be accelerated by the reduced accelerating electric field in the decoupled regions downstream of the detuned side cavities. In this embodiment, the second activation state of electronic switches 40,42 can change the resonant frequency of detunable side cavities 32, 34 such that the second set of electrons is accelerated by substantially the maximum attainable amplitude of the electric field of the electromagnetic wave in substantially all of the main cavities. That is, the electronic switches 40, 42 are activated to a resonant state such that they operate essentially as side cavities that do not include an electronic switch (such as side cavities 30, 36 of FIG. 1). In this embodiment, the first energy can be lower than the second energy.

In an operation to obtain a first energy greater than a second energy, the second activation state can decouple the portions of the LINAC downstream of the detuned side cavities, while the first activation state can change the resonant frequency of detunable side cavities 32, 34 such that the first set of electrons is accelerated by substantially the maximum attainable amplitude of the electric field of the electromagnetic wave in substantially all of the main cavities.

In one example, all of steps 100 to 110 can be performed in the duration of a single pulse of the electromagnetic wave. For example, the command can be issued to inject the first set of electrons into the LINAC (step 102) during the filling time of the electromagnetic wave into the LINAC to achieve, almost immediately, the beam loaded steady state. The electronic switches can then be activated, substantially simultaneously, to the second activation (step 106), which can raise the electromagnetic fields in the main cavities downstream of the detunable side cavities. A command can be issued to inject the second set of electrons into the LINAC (step 108) while the electromagnetic fields in the downstream region of the LINAC are still rising, so that the beam energy can achieve, almost immediately, the beam loaded steady state. In this example, the electromagnetic wave can be coupled into the LINAC after step 100 but before step 102.

In another example, Steps 100 to 104 can be performed during a first pulse of the electromagnetic wave, and step 106 to 110 can be performed during a second pulse of the electromagnetic wave.

If electronic switches 40 and 42 are of the same type, then they can be activated similarly for each activation state. That is, to reach the first activation state, electronic switches 40 and 42 can be activated to the same extent. For example, the same level of current or voltage can be applied to each, or the same type of transmission line (coaxial cable) is attached to each. To reach the second activation state, electronic switches 40 and 42 can be activated, substantially simultaneously, to an activation state which is different from the first activation state. For example, a same level of current or voltage is applied, or type of transmission line (coaxial cable) is attached to each, but which differs from that applied for the first activation state. If electronic switches 40 and 42 are different types of electronic switches, for example, one may be a microwave switch while the other is an electromechanical switch, then the two can be activated to a different degree, but with the end result being that they each change the impedance of the respective detunable side cavity to essentially the same degree, to have a similar effect on the resonant frequency of the respective detunable side cavities.

While in the illustration of FIG. 1, the standing wave LINAC includes two detunable side cavities which are diagonally-positioned, any configuration deemed suitable by one of skill can be used. For example, the methods also can be performed with the standing wave LINAC illustrated in FIG. 4, where electronic switches of two detunable side cavities, positioned adjacent to each other on a side of the LINAC, are activated substantially simultaneously. In this arrangement, the detunable side cavities are separated by approximately $2\pi$ radians. This arrangement may be preferable if there are size or space constraints, since the combined LINAC-detunable side cavities are narrower in this configuration.

Figure 4:
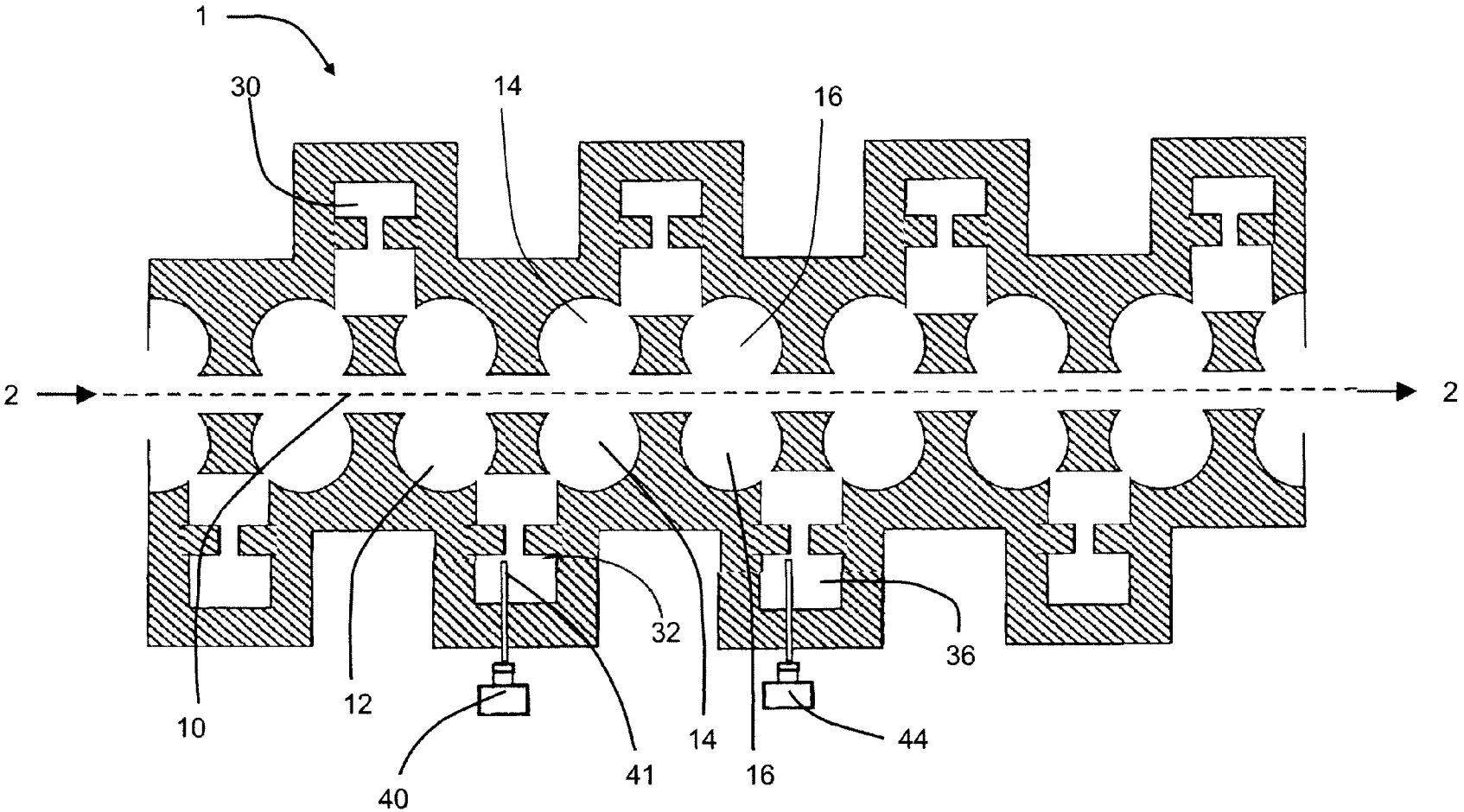
FIG. 4 shows a standing wave LINAC with two detunable side cavities positioned adjacent to each other on a side of the LINAC.
Figure 5:
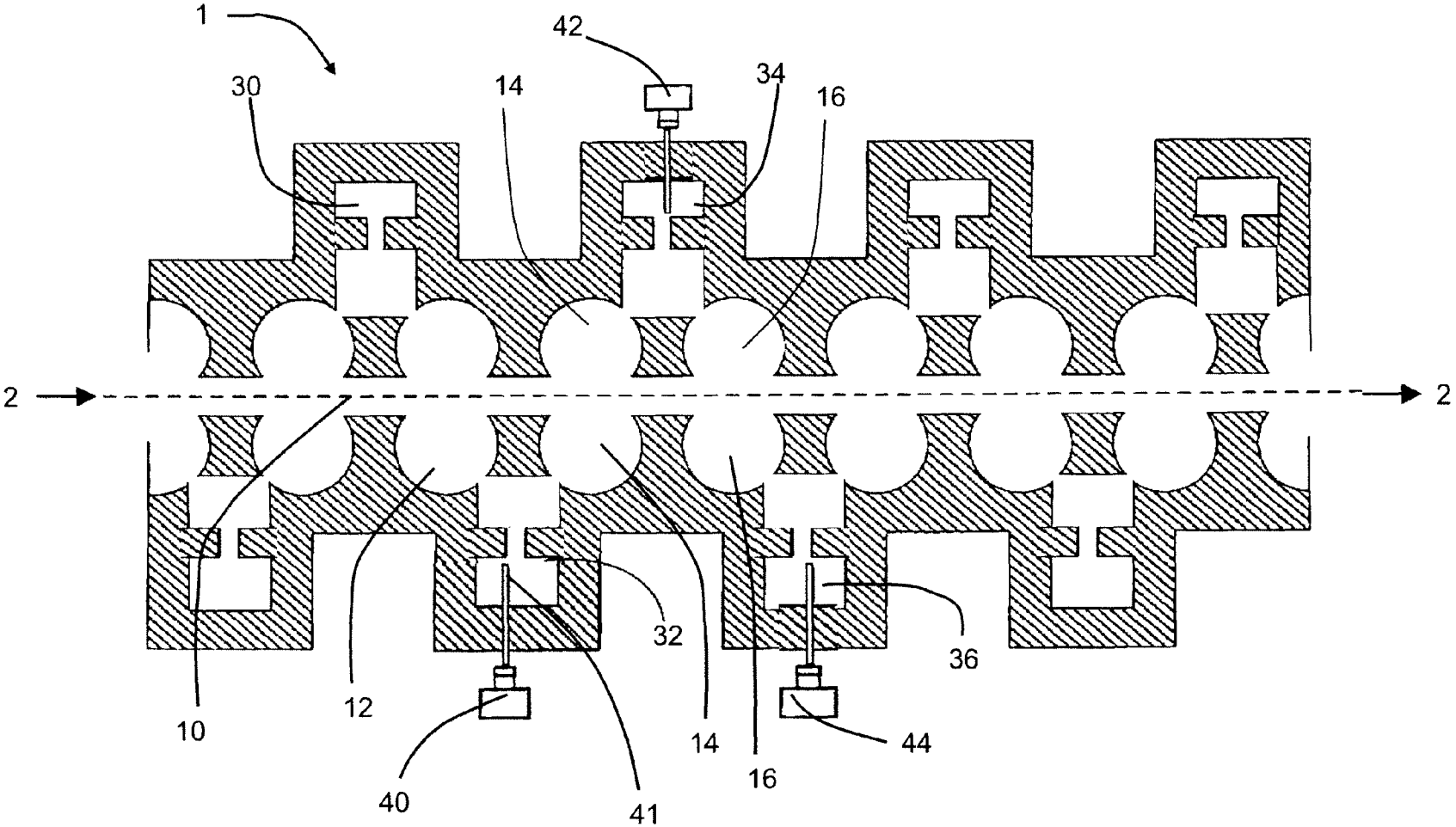
FIG. 5 shows a standing wave LINAC with three detunable side cavities.
Figure 6:
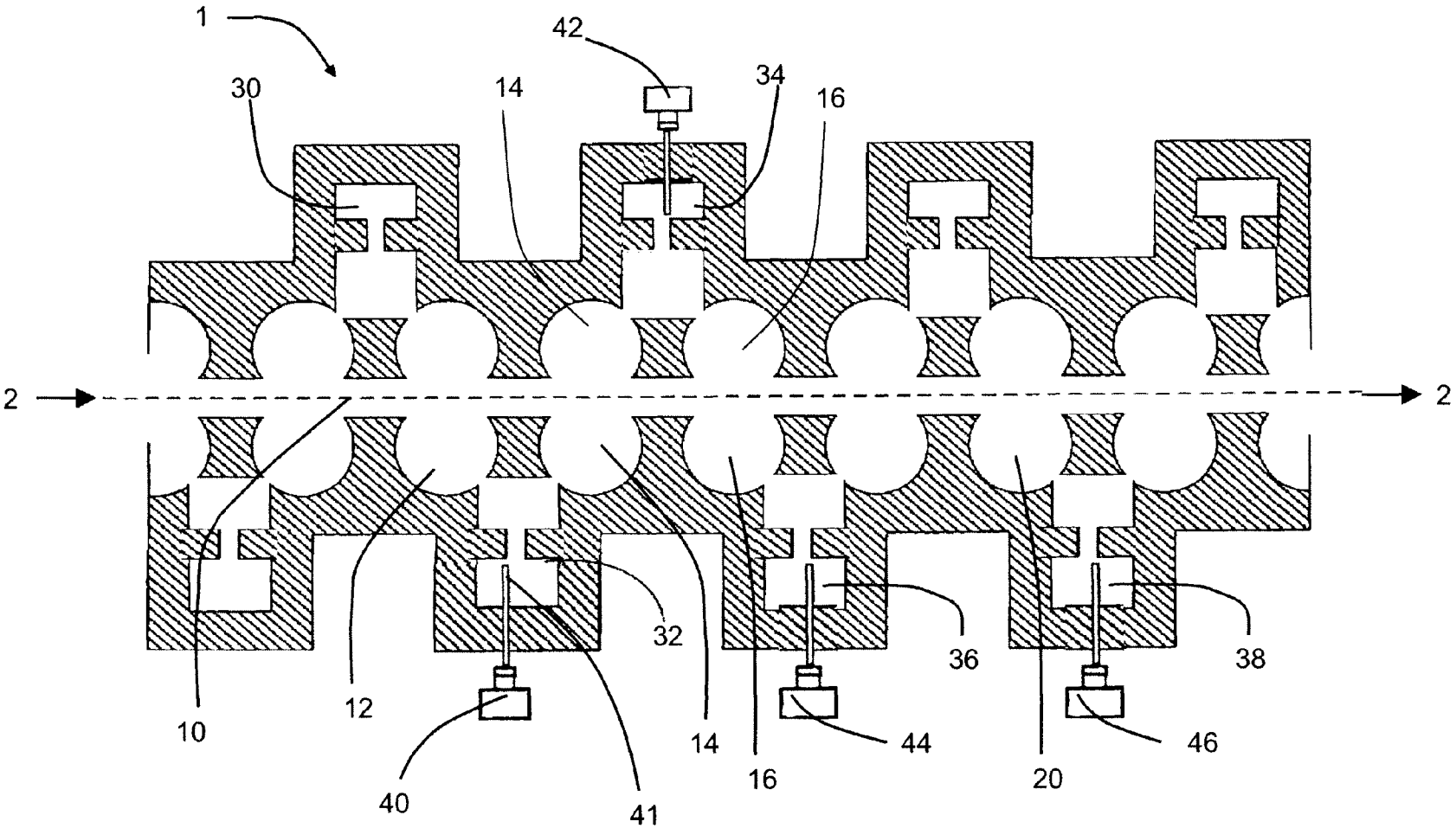
FIG. 6 shows a standing wave LINAC with four detunable side cavities.

Furthermore, more than two detuned side cavities can be used according to the methods disclosed herein. In a $\pi/2$ biperiodic structure such as the standing wave LINACs discussed herein, two adjacent side cavities as illustrated in FIG. 1 are approximately a half wavelength ($\pi$ radians) apart. The detuned side cavities as illustrated in FIG. 4 are a wavelength ($2\pi$ radians) apart. In certain embodiments, the systems and methods disclosed herein can be applied to detuned side cavities that are spaced an integer multiple of a half wavelength apart. In specific embodiments, the detuned side cavities can be spaced up to about 3/2 wavelength ($3\pi$ radians) apart or up to about 2 wavelengths ($4\pi$ radians). In a microwave transmission line, two impedances that are approximately an integer multiple of a half wavelength apart can be considered effectively in parallel with each other. Therefore with appropriate adjustment, two or more detunable side cavities can be made to dissipate an approximately equal amount of power, so that the dissipation involved in reflecting the power can be divided between the two or more detunable side cavities. That is, if electronically detuning two adjacent detunable side cavities still results in undesired or unacceptable heating of the electronic switches, detuning a third adjacent detunable side cavity can help to further reduce the possibility of heating. Thus, the methods disclosed herein are applicable to a LINAC with three detunable side cavities. FIG. 5 illustrates a LINAC with three detonable side cavities arranged diagonally across from each other, but other arrangements of the three may be used. The three detunable side cavities can be activated, substantially simultaneously, as previously described for a LINAC with two detunable side cavities. Furthermore, the method can be applied to a LINAC with four (such as illustrated in FIG. 6) or more detunable side cavities, arranged in any permutation relative to the body of the LINAC.

5.2.2 Modified Detunable Side Cavities

In another aspect, a detunable side cavity may be modified such that it is not needed to activate the electronic switches to tune the resonant frequency of the detunable side cavity when the LINAC is operated in a mode where the electron beam is accelerated by substantially the maximum attainable amplitude of the electric field of the electromagnetic wave in substantially all of the main cavities. A system comprising one or more of the modified detunable side cavities may be operated with advantageously low heating in the electronic switch during a fast-switching operation of the LINAC. Specifically, the electronic switch is integrated with the side cell as an un-detuned structure to avoid the overheating that can occur for high-energy operation.

A side cavity comprising an electronic switch differs from a side cavity comprising a mechanical switch in that, when the mechanical switch is used in high-energy operation, the mechanical switch may not experience much heating due to the microwave power by being withdrawn. As discussed above, overheating can be a problem for an electronic switch. If the electronic switch is used for precise tuning of the side cavity, the electronic switch is conducting power in the side cavity when the accelerator is being operated in its high energy mode. That is, an electronic switch in a side cavity may experience some amount of heating even if it is not activated to detune the side cavity. In a side cavity that is not modified, the electronic switch may be switched between one activation state (for output of electrons with maximum attainable energy) and another activation state (for output of electrons of a lower energy) by, for example, switching between two different types of transmission lines, one of which is tuned to put the side cavity at the resonant frequency of the LINAC, and the other being tuned to detune the side cavity. In this approach, the electronic switch is experiencing some amount of heating during the operation of the LINAC.

In this aspect, a detunable side cavity is modified so that the detunable side cavity is tuned to have the resonant frequency of the standing wave LINAC while the conductive member is in place but the electronic switch is not activated. The standing wave linear accelerator comprises at least one modified detunable side cavity (i.e., a side cavity comprising an electronic switch). The modified detunable side cavity is configured so that the reactance of the modified detunable side cavity in the presence of an electromagnetic wave coupled into the LINAC, and when the electronic switch is not activated, is substantially similar to a reactance of side cavities that do not comprise an electronic switch. That is, the capacitive reactance and/or inductive reactance of the detunable side cavity can be modified. The modified detunable side cavity operates essentially as a node of the standing wave LINAC in the absence of any activation of the electronic switch, resulting in minimal or no power loss in the modified detunable side cavity.

When the electronic switch of the modified detunable side is activated, the side cavity is detuned, which disrupts the standing electromagnetic wave downstream of the modified detunable side cavity. As a result, as discussed in Section 5.2.1, the set of electrons injected into a longitudinal passageway of the LINAC experience significantly less acceleration in the downstream main cavities, and are emitted at a lower energy. The electronic switch of the modified detunable side cavity can be activated by any means known in the art, such as those discussed above in Section 5.2.1. As non-limiting examples, an electronic switch can be activated by application of a current to the electronic switch, by application of a voltage to the electronic switch, or by connecting one or more coaxial transmission lines.

Figure 7B:
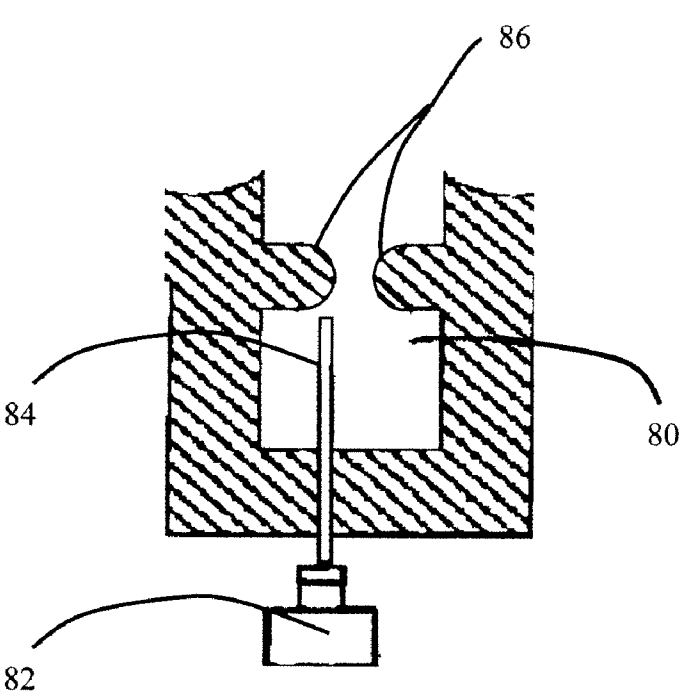
FIGS. 7A and 7B show cross sections of detunable side cavities.
Figure 7A:
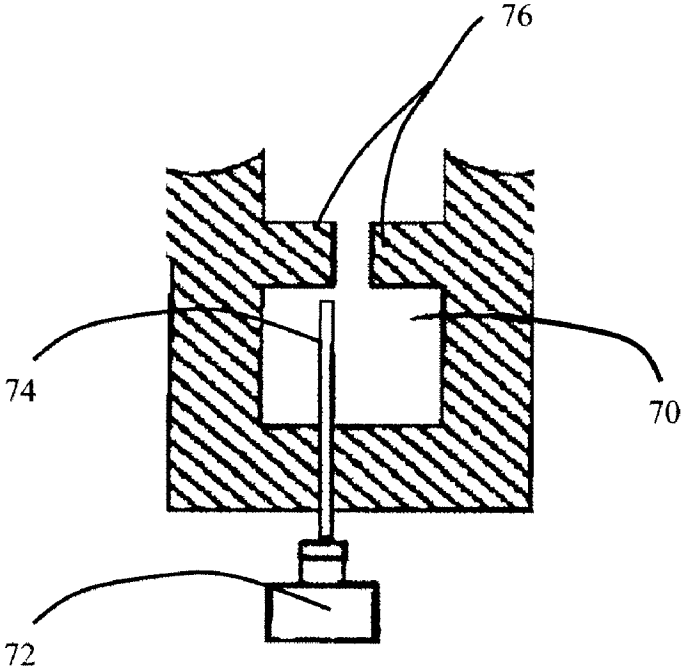

FIG. 7A shows an example of a detunable side cavity 70 that has not been modified, and which could be prone to overheating during an operation of the LINAC. The unmodified detunable side cavity includes a electronic switch 72, conductive member 74, and posts 76. Conductive member 74 can be a conductive loop or a conductive prong. The faces of the posts 76 run parallel to each other. FIG. 7B shows an example of a detunable side cavity 80 that has been modified so that the detunable side cavity is tuned to have the resonant frequency of the standing wave LINAC while the conductive prong 84 is in place but the electronic switch 82 is not activated. In FIG. 7B, the faces of the posts 86 are modified in order to change the reactance of the modified detunable side cavity, so that the modified detunable side cavity operates at the resonant frequency of the LINAC without power loss to the electronic switch. In the example of FIG. 7B, the shape of the faces of the post are given a rounded shape, which changes the capacitance between the two posts and hence the reactance of the side cavity, so that this modified detunable side cavity operates like a "node" of the LINAC in the absence of activation of the electronic switch. While a rounded shape is depicted in FIG. 7B, any other morphology that results in the modified detunable side cavity operating like a "node" of the LINAC in the absence of activation of the electronic switch is applicable to this aspect. In another example, the faces of the posts of the modified detunable side cavity are moved closer together, or farther apart, to change the capacitance and hence reactance. In yet another example, the size (and hence the volume) of the side cavity can be changed to change the inductance (and hence reactance) of the side cavity. In yet another example, the detunable side cavity is modified so that the detunable side cavity is tuned to have the resonant frequency of the LINAC while the conductive member is in place but the electronic switch is open circuited. For example, for a detunable side cavity that is detuned by the connection of different coaxial cables, the wavelength at X-band in a coaxial cable is about one inch (the distance through the coaxial connector to the electronic switch) may be resonant, therefore, a short delay line may be added that is tuned to be non-resonant at the accelerator operating frequency. In yet another example, the post is made of a different material (such as but not limited to a different metal or alloy, or a dielectric, including but not limited to a ceramic, or mixtures thereof), from the material of rest of the detunable side cavity, in order to modify the reactance. For example, the body of a side cavity can be made of copper, and the post can be made of a copper alloy, brass, a ceramic, or other suitable material.

Figure 8:
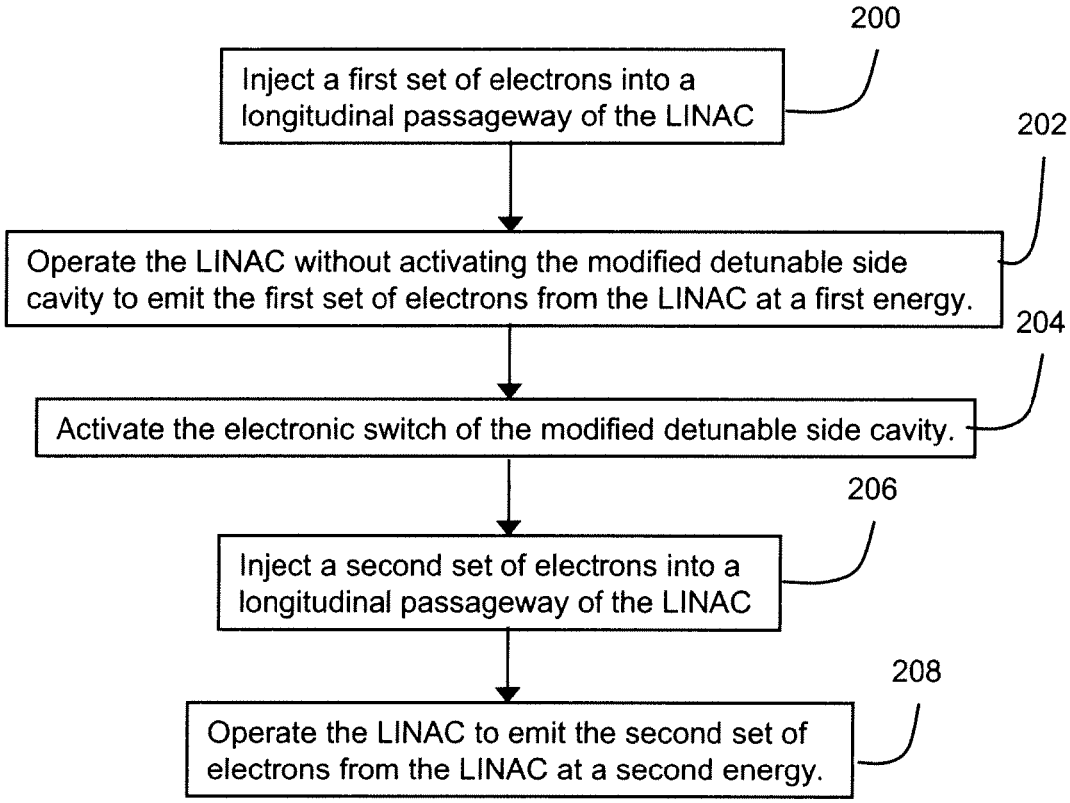
FIG. 8 shows a flow chart of the operation of a LINAC according to a second aspect.

FIG. 8 shows a flow chart of the operation of a LINAC that includes a modified detunable side cavity. In step 200 of FIG. 8, a command is issued to the electron gun to inject a first set of electrons into longitudinal passageway 10 of the LINAC. In step 202, a command is issued to operate the LINAC so that the first set of electrons would be emitted from the LINAC at a first energy. The time interval between steps 200 and 202, and the order of the steps, can be selected to result in the first set of electrons being emitted at the desired dose rate and first energy. In step 204, a command is issued to activate the electronic switch of the modified detunable side cavity, which decouples the portions of the LINAC downstream of the detuned side cavities, substantially reducing the accelerating electric field in the decoupled regions. In step 206, a command is issued to the electron gun to inject a second set of electrons into longitudinal passageway 10. The second set of electrons would be accelerated by substantially the maximum attainable amplitude of the electric field of the electromagnetic wave in the main cavities upstream of the detuned side cavities, and be accelerated by the reduced accelerating electric field in the decoupled regions downstream of the detuned side cavities. In step 208, a command is issued to operate the LINAC so that the second set of electrons would be emitted from the LINAC at a second energy which is different from the first energy.

A system according to this aspect also may comprise more than one modified detunable side cavity. In operation of this LINAC, to emit the second set of electrons at the second energy, the electronic switches of the two or more modified detunable side cavities can be activated substantially simultaneously as previously described to achieve advantageously low heating of the electronic switches.

5.3 X-Rays

X-rays are generated from the bombardment of a target material by the accelerated electron beam or electron bunches from a LINAC. The x-rays can be generated from a target through two different mechanisms. In the first mechanisms, collision of the electrons from the LINAC an atom of a target can impart enough energy so that electrons from the atom's lower energy levels (inner shell) escape the atom, leaving vacancies in the lower energy levels. Electrons in the higher energy levels of the atom descend to the lower energy level to fill the vacancies, and emit their excess energy as x-ray photons. Since the energy difference between the higher energy level and the lower energy level is a discrete value, these x-ray photons appear in the x-ray spectrum as sharp lines (called characteristic lines). In the second mechanisms, the electron beams or bunches from the LINAC are scattered by the strong electric field near the atoms of the target and give off Bremsstrahlung radiation. Bremstrahlung radiation produces x-rays photons in a continuous spectrum, where the intensity of the x-rays increases from zero at the energy of the incident electrons. That is, the highest energy x-ray that can be produced by the electrons from a LINAC is the highest energy of the electrons when they are emitted from the LINAC. The Bremsstrahlung radiation can be of more interest than the characteristic lines for many applications.

Materials useful as targets for generating x-rays include tungsten, certain tungsten alloys (such as but not limited to tungsten carbide, or tungsten (95%)-rhenium (5%)), molybdenum, copper, platinum and cobalt.

5.4 Instrumentation

Certain instruments that may be used in operation of a standing wave LINAC include an electron gun, a modulator, and an electromagnetic wave source.

5.4.1 Electron Gun

The electron gun is used as an electron emitter, to emit a set of electrons (or an electron beam) having a specific kinetic energy. The electron gun can be any electron gun deemed suitable by one of skill. For example, the L3 electron gun assembly, model number M592 (L3 Communications Corporation, San Carlos, Calif.) can be used. The electron gun can include a thermionic cathode for emitting a stream of electrons. The electron gun also may comprise a focusing component to focus the stream of electrons. For example, a focus electrode can be used to shape the electric fields so as to focus the electron beam into a convergent beam with a minimal diameter appearing beyond the anode. In some electron guns, the focusing component is a grid positioned between the anode and the thermionic cathode, which applies fields for controlling the diameter of the electron stream. Such a grid can have an aperture located concentric with the common longitudinal axis of the anode and cathode. In some electron guns, the grid can include an intercepting screen capable of turning the beam on and off and of controlling the beam current, depending on the voltage applied to the grid. The anode can also have an aperture concentric with the longitudinal axis. The diameter of the aperture of the anode can be smaller than the diameter of the cathode. A voltage can be applied to the grid and the anode relative to the cathode to produce a convergent axial electric field between the grid and the anode, which can cause a quasi-laminar flow of electrons having a current density that increases from the cathode towards the anode. Reducing the voltage applied to the electron gun can decrease the kinetic energy of the electrons ejected from the electron gun.

5.4.2 Modulator

A modulator generates high-voltage pulses lasting a few microseconds. These high-voltage pulses can be supplied to the electromagnetic wave source (discussed in Section 5.4.3 below), to the electron gun (see Section 5.4.1), or to both simultaneously. A power supply provides DC voltage to the modulator, which converts this to the high-voltage pulses. For example, the Solid State Magnetron Modulator -M1 or -M2 (ScandiNova Systems AB, Uppsala, Sweden) can be used in connection with a magnetron. In another example, the Solid State Klystron Modulator -K1 or -K2 (ScandiNova Systems AB, Uppsala, Sweden) can be used in connection with a klystron.

5.4.3 Microwave Generators

The electromagnetic wave source can be any electromagnetic wave source deemed suitable by one of skill. The electromagnetic wave source (in the microwave of radio frequency ("RF") range) for the LINAC typically is either a magnetron oscillator or a klystron amplifier. In both types of instruments, the size of the RF source and the power output capability are roughly proportional to the wavelength of the electromagnetic wave. The electromagnetic wave can be modified by changing its amplitude, frequency, or phase.

5.4.3.1 Magnetron

A magnetron functions as a high-power oscillator, to generate microwave pulses of several microseconds duration and with a repetition rate of several hundred pulses per second. The frequency of the microwaves within each pulse is typically about 3,000 MHz (S-band) or about 9,000 MHz (X-band). For very high peak beam currents or high average currents, 800 to 1500 MHz (L-band) pulses can be used. The magnetron can be any magnetron deemed suitable by one of skill. For example, the CTL X-band pulsed magnetron, model number PM-1100X (L3 Communications, Applied Technologies, Watsonville, Calif.) can be used. Typically, the magnetron has a cylindrical construction, having a centrally disposed cathode and an outer anode, with resonant cavities machined out of a solid piece of copper. The space between the cathode and the anode is evacuated. The cathode is heated by an inner filament, and the electrons are generated by thermionic emission. A static magnetic field is applied perpendicular to the plane of the cross-section of the cavities, and a pulsed DC electric field is applied between the cathode and the anode. The electrons emitted from the cathode are accelerated toward the anode by the action of the pulsed DC electric field and under the influence of the magnetic field. Thus, the electrons move in a complex spiraling motion towards the resonant cavities, causing them to radiate electromagnetic radiation at a frequency in the microwave. The generated microwave pulses are fed to an accelerator structure via a transfer waveguide. Magnetrons typically operate at 1 or 2 MW peak power output to power low-energy LINACs (6 MV or less). Magnetrons can be relatively inexpensive and can be made compact, which is advantageous for many applications, but can have limited output power and limited lifetime, and can provide relatively limited control over the electromagnetic wave frequency and phase. Continuous-wave magnetron devices can have an output power as high as about 100 kW at 1 GHz with efficiencies of about 75-85 percent while pulsed devices can operate at about 60-77 percent efficiency. Magnetrons can be used in single-section low energy linear accelerators that may not be sensitive to phase. The magnetron is usually used with a feedback system to stabilize the microwave output.

5.4.3.2 Klystron

The klystron can be any klystron deemed suitable by one of skill. For example, the CPI S-band pulsed klystron, model number VKS-8262G (Communications and Power Industries (CPI), Palo Alto, Calif.) can be used. A klystron acts as an amplifier by converting the kinetic energy of a DC electron beam into microwave power. A beam of electrons produced by a thermionic cathode (a heated pellet of low work function material) is accelerated by high voltage electrodes (typically in the tens to hundreds of kilovolts). This beam of electrons is then passed through an input cavity. Microwave is fed into the input cavity of the klystron at, or near, the natural resonant frequency of the klystron cavity. The electric field of the microwave causes the previously continuous electron beam to form bunches at the input frequency. To reinforce the bunching, a klystron can contain additional buncher cavities. The microwave frequency current carried by the electron beam produces a microwave frequency magnetic field, which in turn excites a voltage across the gap of subsequent resonant cavities. In the output cavity, the developed microwave power is coupled out of the klystron. The spent electron beam, having reduced energy, is captured in a collector. The klystron acts as an amplifier, because the output power of the microwave from a klystron can be much larger (typically 50 to 60 db) than the microwave input power, resulting in the amplified microwave power that can be phase stable with respect to the microwave input power. Since it is an amplifier, a klystron can be agile in changing the frequency and amplitude of the output microwave.

5.5 Exemplary Apparatus and Computer-Program Implementations

Aspects of the methods disclosed herein can be performed using a computer system, such as the computer system described in this section, according to the following programs and methods. For example, such a computer system can store and issue the commands to the control units to activate the electronic switches to the different activation states, or commands to operate the various other components of the LINAC, according to the methods disclosed herein. The systems and methods may be implemented on various types of computer architectures, such as for example on a single general purpose computer, or a parallel processing computer system, or a workstation, or on a networked system (e.g., a client-server configuration such as shown in FIG. 9).

Figure 9:
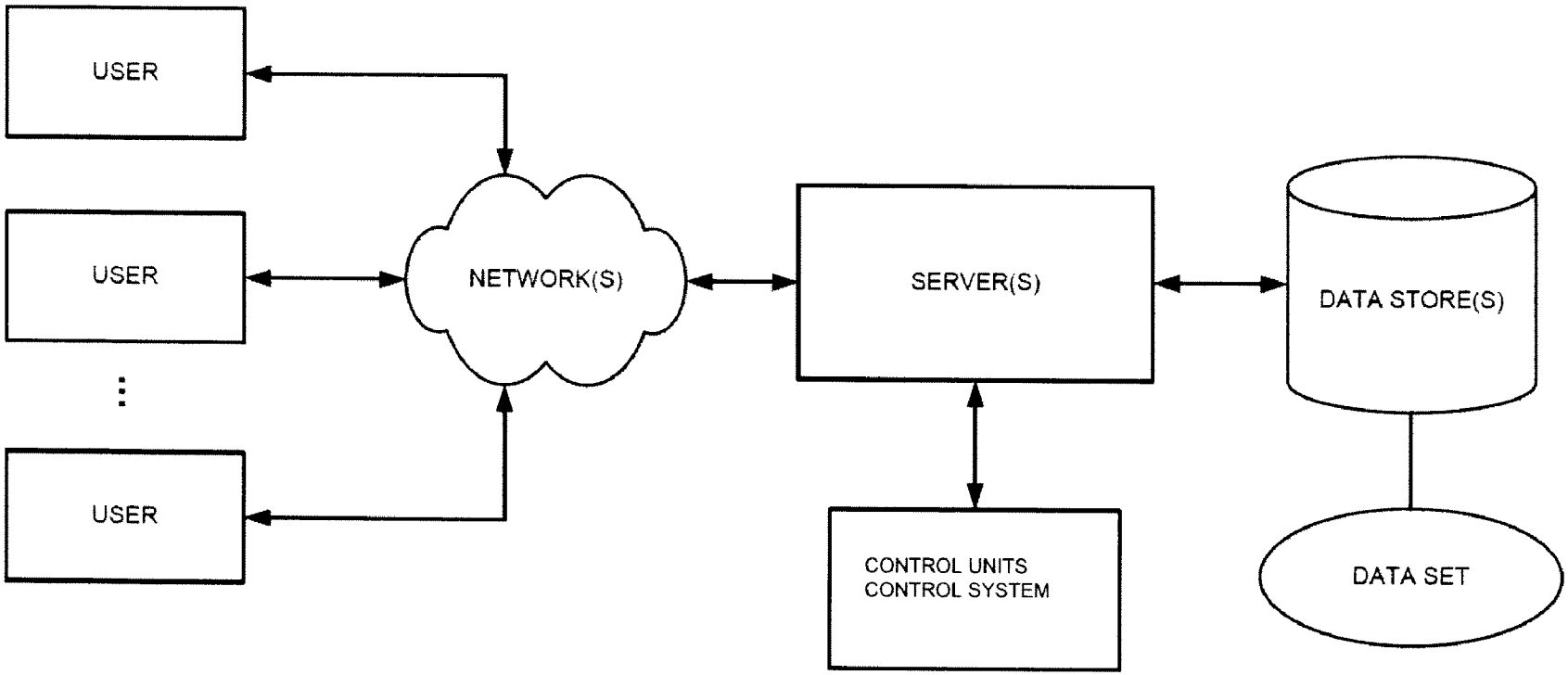
FIG. 9 illustrates an example computer system for use in implementing the methods.

An exemplary computer system suitable for implementing the methods disclosed herein is illustrated in FIG. 9. As shown in FIG. 9, the computer system to implement one or more methods and systems disclosed herein can be linked to a network link which can be, e.g., part of a local area network ("LAN") to other, local computer systems and/or part of a wide area network ("WAN"), such as the Internet, that is connected to other, remote computer systems. A software component can include programs that cause one or more processors to issue commands to one or more control units, which cause the one or more control units to issue commands to cause the electron gun to inject a first set of electrons into the longitudinal passageway of the LINAC, to cause the electronic switches to activate to an activation state, and to operate the LINAC (including commands for coupling the electromagnetic wave into the LINAC, and initiating the AFC). For example, the system can accept commands to cause the one or more control units to activate, substantially simultaneously, two or more electronic switches to an activation state which decouples the portions of the LINAC downstream of the detuned side cavities (as discussed above). The programs can cause the system to retrieve commands for executing the steps of the methods in specified sequences and at specified time intervals between the steps, from a data store (e.g., a database). Such a data store can be stored on a mass storage (e.g., a hard drive) or other computer readable medium and loaded into the memory of the computer, or the data store can be accessed by the computer system by means of the network.

In addition to the exemplary program structures and computer systems described herein, other, alternative program structures and computer systems will be readily apparent to the skilled artisan. Such alternative systems, which do not depart from the above described computer system and programs structures either in spirit or in scope, are therefore intended to be comprehended within the accompanying claims.

6. REFERENCES CITED

All references cited herein are incorporated herein by reference in their entirety and for all purposes to the same extent as if each individual publication or patent or patent application was specifically and individually indicated to be incorporated by reference in its entirety herein for all purposes. Discussion or citation of a reference herein will not be construed as an admission that such reference is prior art to the present invention.

7. MODIFICATIONS

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

What is claimed is:

1. A method of reducing heating during a fast-switching operation of a standing wave linear accelerator, the accelerator comprising a longitudinal passageway, a plurality of main cavities disposed along the longitudinal passageway, and a plurality of side cavities each coupled to two neighboring main cavities and having a resonance frequency, said method comprising:

respectively providing first and second side cavities of the plurality with first and second electronic switches each configured to detune the resonance frequency of its respective cavity;

generating a standing electromagnetic wave in the accelerator;

injecting a first set of electrons into the longitudinal passageway;

accelerating the first set of electrons with the standing electromagnetic wave to a first energy while the first and second switches are in a first state in which the first side cavity and the first electronic switch together have substantially the same reactance as do the second side cavity and the second electronic switch together;

activating the first and second switches at substantially the same time as one another to a second state in which the first side cavity and the first electronic switch together have substantially the same reactance as do the second side cavity and the second electronic switch together, the reactance in the second state being different from the reactance in the first state, the second state modifying the standing electromagnetic wave;

injecting a second set of electrons into the longitudinal passageway; and accelerating the second set of electrons with the modified electromagnetic wave to a second energy which is different from the first energy.

2. The method of claim 1, wherein the first and second electronic switches each detune their respective cavity when activated to the first state.

3. The method of claim 1, comprising, activating the first and second switches substantially simultaneously with one another to said first state before injecting the first set of electrons into the longitudinal passageway.

4. The method of claim 3, comprising activating the first and second electronic switches to the first state at a time interval of at least one switching time before injecting the first set of electrons.

5. The method of claim 1, comprising activating the first and second electronic switches to the second state at a time interval of at least one switching time before injecting the second set of electrons.

6. The method of claim 1, wherein the first and second electronic switches detune their respective cavity when activated to the second state.

7. The method of claim 1, wherein the first and second side cavities are positioned adjacent to each other on the same side of the accelerator.

8. The method of claim 1, wherein the first and second side cavities are positioned diagonally across from each other on opposite sides of the accelerator.

9. The method of claim 1, comprising activating the first and second electronic switches to the first state by applying a first current to each of the first and second electronic switches.

10. The method of claim 9, comprising activating the first and second electronic switches to the second state by applying a second current to each of the first and second electronic switches, wherein said first current is different from said second current.

11. The method of claim 1, wherein each of the first and second electronic switches respectively comprises a conductive member positioned inside the respective side cavity.

12. The method of claim 11, wherein an end of the conductive member extends to the exterior of the respective side cavity and is connectable to at least one coaxial transmission line.

13. The method of claim 12, comprising activating the first and second electronic switches to the first state by connecting a first coaxial transmission line to each of the first and second electronic switches.

14. The method of claim 13, comprising activating the first and second electronic switches to the second state by connecting a second coaxial transmission line to each of the first and second electronic switches, wherein the first coaxial transmission line is different from the second coaxial transmission line.

15. The method of claim 1, further comprising providing each of one or more additional side cavities with a respective electronic switch.

16. A standing wave linear accelerator comprising:

a plurality of main cavities and a plurality of side cavities, wherein each said side cavity couples to two neighboring main cavities of said plurality of main cavities and has a resonance frequency, wherein a first side cavity of the plurality comprises an electronic switch configured to detune the resonance frequency of the side cavity, and wherein the first side cavity has a configuration different than other side cavities of the plurality that do not comprise an electronic switch, the configuration being such the first side cavity and the electronic switch together have substantially the same reactance as do the other side cavities when the electronic switch is not activated.

17. The standing wave linear accelerator of claim 16, wherein each side cavity of the plurality comprises one or more posts, and wherein the one or more posts of the first side cavity are configured differently than the one or more posts of the other side cavities.

18. The standing wave linear accelerator of claim 17, wherein a material of the one or more posts of the first side cavity comprises a copper alloy, brass, a ceramic, or combinations thereof.

19. A method for operating a standing wave linear accelerator comprising a plurality of main cavities and a plurality of side cavities, each side cavity being coupled to two neighboring main cavities and having a resonance frequency, said method comprising:

providing a first side cavity of the plurality with an electronic switch configured to detune the resonance frequency of the first side cavity, the first side cavity having a configuration different than other side cavities of the plurality that do not comprise an electronic switch, the configuration being such that the first side cavity and electronic switch together have substantially the same reactance as do the other side cavities when the electronic switch is not activated;

generating a standing electromagnetic wave in the accelerator;

injecting a set of electrons into said accelerator; and accelerating the set of electrons to an energy with the standing electromagnetic wave.

20. The method of claim 19, comprising activating the electronic switch before coupling said electromagnetic wave into said accelerator.

21. The method of claim 20, comprising activating the electronic switch by applying a current to said electronic switch.

22. The method of claim 19, wherein said electronic switch comprises a conductive member positioned inside the first side cavity.

23. The method of claim 22, wherein an end of the conductive member extends to the exterior of the first side cavity and is connectable to at least one coaxial transmission line.

24. The method of claim 23, wherein said electronic switch is activated by connecting a coaxial transmission line to said end.

25. A method for reducing heating in a fast-switching operating of a standing wave linear accelerator, the accelerator comprising a longitudinal passageway, a plurality of main cavities disposed along the longitudinal passageway, and a plurality of side cavities each coupled to two neighboring main cavities and having a resonance frequency, said method comprising:

providing a first side cavity of the plurality with an electronic switch configured to detune the resonance frequency of the first side cavity, the first side cavity having a configuration different than other side cavities of the plurality that do not comprise an electronic switch, the configuration being such that the first side cavity and electronic switch together have substantially the same reactance as do the other side cavities when the electronic switch is not activated;

generating a standing electromagnetic wave in the accelerator;

injecting a first set of electrons into the longitudinal passageway;

accelerating the first set of electrons with the standing electromagnetic wave to a first energy and without activating the electronic switch activating the electronic switch so as to modify the standing electromagnetic wave;

injecting a second set of electrons into the longitudinal passageway; and accelerating the second set of electrons a second energy with the modified standing electromagnetic wave, the second energy being different from said first energy.

26. The method of claim 25, comprising activating the electronic switch before injecting the second set of electrons.

27. The method of claim 26, comprising activating the electronic switch by applying a current to the electronic switch.

28. The method of claim 25, wherein said electronic switch comprises a conductive member positioned inside the first side cavity.

29. The method of claim 28, wherein an end of conductive member extends to the exterior of the first side cavity and is connectable to at least one coaxial transmission line.

30. The method of claim 29, wherein said electronic switch is activated by connecting a coaxial transmission line to said end.

* * * * *